United States Patent [19]

Pacholski et al.

[11] 4,253,297

[45] Mar. 3, 1981

[54] METHOD AND APPARATUS FOR THE PRODUCTION OF CORE YARN

[75] Inventors: Jan Pacholski; Zenon Kujawski; Ryszard Janczyk; Marian Bartczak, all of Lódź, Poland

[73] Assignee: Centralny Osrodek Badawczorozwojowy Maszyn Wlokienniczych "Polmatex-Cenaro", Lódź, Poland

[21] Appl. No.: 948,008

[22] Filed: Sep. 29, 1978

Related U.S. Application Data

[63] Continuation-in-part of Ser. No. 890,820, Mar. 27, 1978, abandoned.

[30] Foreign Application Priority Data

Mar. 31, 1977 [PL] Poland ..... 197115

[51] Int. Cl.[3] ..... D01H 1/13; D02G 3/36

[52] U.S. Cl. ..... 57/5; 57/58.89; 57/224

[58] Field of Search ..... 57/5, 6, 58.89–58.95, 57/224

[56] References Cited

U.S. PATENT DOCUMENTS

| | | | |
|---|---|---|---|
| 3,445,993 | 5/1969 | Vorisek | 57/58.95 X |
| 3,577,720 | 5/1971 | Zax et al. | 57/58.89 |
| 3,605,395 | 9/1971 | Morikawa et al. | 57/58.95 X |
| 3,851,455 | 12/1974 | Jozwicki et al. | 57/5 X |
| 3,994,120 | 11/1976 | Radom et al. | 57/58.89 |
| 4,083,173 | 4/1978 | Artzt et al. | 57/5 X |

FOREIGN PATENT DOCUMENTS

| | | | |
|---|---|---|---|
| 67331 | 2/1973 | Poland . | |
| 73353 | 12/1975 | Poland | 57/58.89 |
| 1381582 | 1/1975 | United Kingdom . | |
| 1427373 | 3/1976 | United Kingdom . | |
| 1463481 | 2/1977 | United Kingdom . | |
| 445210 | 10/1975 | U.S.S.R. . | |

*Primary Examiner*—John Petrakes
*Attorney, Agent, or Firm*—Haseltine and Lake

[57] ABSTRACT

A method and apparatus for producing core yarn comprising introducing yarn constituting the core through a supply channel into a stationary spinning chamber, leading the yarn inside the chamber along a straight line to staple fibres rotating in a plane perpendicular to the axis of the chamber, joining and wrapping the core with the staple fibres and guiding the finished yarn out of the chamber to take-up rollers. The spinning chamber comprises two cylindrical chambers with different diameters adjoining one another and in the cylindrical chamber of greater diameters there are tangentially disposed air guide vanes, a channel for discharge of the finished yarn, and a channel for supplying the staple fibres. The outlet of the channel for supplying the staple fibres is disposed above the inlet of the channel for discharge of the finished yarn and above the air guide vanes. In a widening portion of the cylindrical chamber of smaller diameter the inlet of the channel for supplying the yarn is provided.

7 Claims, 1 Drawing Figure

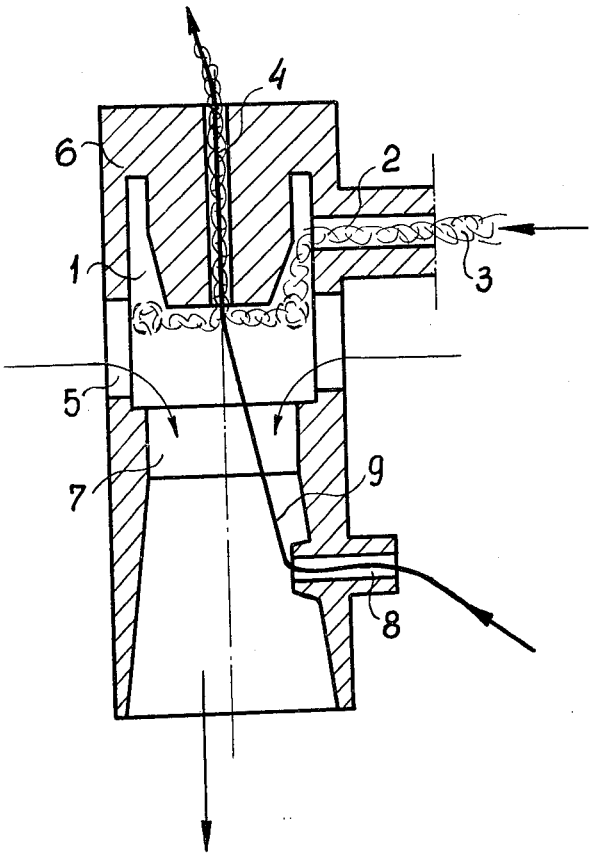
4
6
2
1
3
5
7
9
8

METHOD AND APPARATUS FOR THE PRODUCTION OF CORE YARN

CROSS-RELATED APPLICATION

This application is a continuation-in-part of Ser. No. 890,820 filed Mar. 27, 1978, now abandoned.

FIELD OF THE INVENTION

This invention relates to a method and apparatus for the production of core yarn with a cover of staple fibres by pneumatic spinning.

PRIOR ART

The production of core yarn with a cover of staple fibres consists in wrapping the core, most often a continuous thread, with a wrapping made of staple fibres.

A method is known from Polish Pat. No. 67 331 for production of the core yarn comprising introducing staple fibres through a channel into a spinning chamber, and causing the fibres to undergo a vortex spinning motion in a plane perpendicular to the axis of the spinning chamber. Through a separate channel situated coaxially with the vortex, the yarn constituting the core is introduced, which is let on a helical path over the inner wall of the spinning chamber into the vortex path of the staple fibres. The wrapping is joined to the core due to the twist obtained as a result of the whirling of the vortex ring of fibres and the resulting yarn is coaxially collected.

The apparatus for application of the method comprises a spinning chamber of cylindrical shape with air guide vanes on the periphery thereof, said air guide vanes having inlets situated tangentially to the inner wall of the chamber and being disposed in at least one common plane perpendicular to the axis of the chamber. The chamber is closed at one end with a partition having a channel for removal of the yarn, and at the other end the chamber is connected to a suction pump or to an air discharge duct when overpressure is employed in the chamber. A channel for supplying staple fibres is placed inside the chamber, its outlet port being situated at a level between the guide vanes and the partition, whereas the channel for supplying the yarn forming the core is situated between the inlets of the guide vanes and the vacuum pump.

In another known device, the channel supplying the staple fibres is situated tangentially to the inner wall of the spinning chamber between the air guide vanes and the closing partition at the end of the chamber.

SUMMARY OF THE INVENTION

The method of production of core yarn according to the invention comprises introducing the yarn forming the core through the supplying channel into a stationary, non-revolving chamber, supplying said yarn inside the chamber along a straight line to staple yarns rotating in a plane perpendicular to the axis of the chamber, joining and wrapping the core with said staple yarns, and leading the finished yarn out of the chamber.

The apparatus for production of yarn according to the invention comprises a stationary non-revolving spinning chamber composed of two cylindrical chambers having different diameters, and adjoining frontally. In the cylindrical chamber having the greater diameter, air guide vanes are disposed tangentially, as well as the channel leading out the finished yarn and the channel supplying the staple fibres, the inlet of which is disposed before the inlet of the channel leading out the finished yarn, and before the air guide vanes, looking towards the vacuum pump. In the chamber having the smaller diameter, in the extending part thereof, there is disposed the inlet of the channel suppying the yarn forming the core.

Due to introduction of the yarn to the staple fibres inside the chamber along a straight line, and due to suitable tensioning thereof, the method of the invention provides uniform application of the wrapping onto the core, and good adherence thereof to the core. Uniform yarn having high strength is produced. This is to be distinguished from Polish Pat. No. 67331 in which the yarn is led to the vortex ring along a helical path on the inner walls of the spinning chamber without the straight line tensioning as in the invention.

BRIEF DESCRIPTION OF THE DRAWING

The device according to the invention will be now described in detail with reference to an exemplary embodiment thereof which in the sole FIGURE of the accompanying drawing is shown in longitudinal section.

DETAILED DESCRIPTION

A spinning chamber having a cylindrical chamber 1 is provided at its periphery with a channel 2 for supplying staple fibres 3. The outlet of channel 2 is disposed above the inlet of a channel 4 for removal of the finished yarn, and above air guide vanes 5 at the periphery of the cylindrical chamber 1, looking towards the vacuum pump. Channel 4 is disposed axially in a closure partition 6 having the approximate shape of frustum of a cone.

The cylindrical chamber 1 at the end remote from partition 6 adjoins frontally a cylindrical chamber 7 having a smaller diameter than chamber 1 and forming therewith the complete spinning chamber. The cylindrical chamber 7 widens downwardly towards the vacuum pump. In the widened part of chamber 7 there is disposed an inlet of a channel 8 for supplying yarn 9 forming the core.

The method of production of the core yarn is effected as follows.

Staple fibres 3 are introduced through channel 2 into the cylindrical chamber 1 of the spinning chamber and the fibres are set in a vortex motion. The yarn 9, forming the core, is introduced through channel 8 and is led to the staple fibres 3 inside the spinning chamber along a straight line between the outlet of the channel 8 and the inlet of the channel 4. The feed of the yarn 9 inside the spinning chamber along the straight line provides a suitable tensioning thereof. which leads to good and uniform adherence of the wrapping to the core. The yarn 9 led to the rotating vortex ring of the staple fibres 3 is wrapped with an envelope of said fibres before reaching channel outlet 4 due to the motion of the vortex ring of fibres, and to the coaxial discharge of the yarn.

The finished yarn is removed from the spinning chamber by means of receiving rollers (not shown) and wound onto a cross spool (not shown).

What is claimed is:

1. Apparatus for producing core yarn comprising a stationary spinning chamber having opposite ends, a partition at one of said ends closing said chamber, the other end being open and connectible with a suction source, air guide vanes disposed at the periphery of said chamber, first channel means for supplying yarn forming a core, second channel means for supplying staple fibers, said spinning chamber including first and second portions respectively having cylindrical sections of larger and smaller diameter adjoining one another in axial alignment along a common axis, the cylindrical section of larger diameter having said air guide vanes and said second channel means opening thereto, said partition being provided with a channel for discharge of finished yarn, said second channel means having an inlet into said chamber at a level beyond the inlet of said channel in said partition into said spinning chamber and beyond the inlet of said air guide vanes into said spinning chamber, said first channel means having an inlet into said spinning chamber at said second portion to lead said yarn towards said channel along a straight line at an angle with respect to said axis of the chamber.

2. Apparatus as claimed in claim 1 wherein said second portion includes a diverging section extending from the cylindrical section.

3. Apparatus as claimed in claim 1 wherein said spinning chamber is vertically disposed with the cylindrical section of larger diameter above the cylindrical section of smaller diameter.

4. Apparatus as claimed in claim 3 wherein said second channel means extends horizontally into said chamber, said inlet of the channel for discharge of finished yarn being at a level below the second channel means.

5. Apparatus as claimed in claim 4 wherein said inlet of the air guide vanes extends below said inlet of the channel for discharge of finished yarn.

6. Apparatus as claimed in claim 5 wherein said first channel means is below said air guide vanes and extends horizontally.

7. Apparatus as claimed in claim 5 wherein said air guide vanes are disposed in said cylindrical section of larger diameter in the vicinity of the junction thereof with the cylindrical section of smaller diameter.

* * * * *